US011330678B2

(12) United States Patent
Terracciano et al.

(10) Patent No.: US 11,330,678 B2
(45) Date of Patent: May 10, 2022

(54) METHOD FOR BOIL DETECTION AND INDUCTION HOB INCLUDING A BOIL DETECTION MECHANISM

(71) Applicant: ELECTROLUX APPLIANCES AKTIEBOLAG, Stockholm (SE)

(72) Inventors: Nicola Terracciano, Ruvo di Ruglia (IT); Laurent Jeanneteau, Forli (IT); Alex Viroli, Forli (IT); Massimo Nostro, Forli (IT); Svend Erik Christiansen, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 447 days.

(21) Appl. No.: 16/335,722

(22) PCT Filed: Aug. 16, 2017

(86) PCT No.: PCT/EP2017/070724
§ 371 (c)(1),
(2) Date: Mar. 22, 2019

(87) PCT Pub. No.: WO2018/054617
PCT Pub. Date: Mar. 29, 2018

(65) Prior Publication Data

US 2020/0022227 A1 Jan. 16, 2020

(30) Foreign Application Priority Data

Sep. 23, 2016 (EP) ..... 16190514

(51) Int. Cl.
*H05B 6/06* (2006.01)
*F24C 15/10* (2006.01)
(Continued)

(52) U.S. Cl.
CPC ..... *H05B 6/062* (2013.01); *F24C 15/106* (2013.01); *H05B 1/0269* (2013.01); *H05B 6/12* (2013.01);
(Continued)

(58) Field of Classification Search
CPC ..... H05B 6/062; H05B 6/065; H05B 6/12; H05B 6/1272; H05B 1/0269;
(Continued)

(56) References Cited

U.S. PATENT DOCUMENTS

2013/0075388 A1* 3/2013 Schilling ..... H05B 6/062 219/660

FOREIGN PATENT DOCUMENTS

DE 10253198 B4 7/2007
EP 1420613 A2 5/2004
(Continued)

OTHER PUBLICATIONS

International Search Report and Written Opinion issued in corresponding PCT application No. PCT/EP2017/070724 dated Nov. 14, 2017, 10 pages.

*Primary Examiner* — Hung D Nguyen
(74) *Attorney, Agent, or Firm* — Pearne & Gordon LLP

(57) ABSTRACT

The invention relates to a method for boil detection at a heating zone of an induction hob (1), the method comprising the steps of: —disabling (S110) a power control mechanism of the induction hob by setting the frequency of the AC-current provided to an induction coil of the induction hob to a fixed value; —measuring (S120) values of an electrical parameter provided within the induction hob (1); —interpolating (S130) the measured electrical parameter values by gathering a plurality of values of the electrical parameter within a time window and calculating the average value of said gathered plurality of values thereby obtaining interpo-
(Continued)

lated electrical parameter values. —calculating (S140) a gradient measure indicative for the differential change of the interpolated electrical parameter values over time; —determining (S150) the boil point based on the calculated gradient measure.

20 Claims, 2 Drawing Sheets

(51) Int. Cl.
*H05B 1/02* (2006.01)
*H05B 6/12* (2006.01)

(52) U.S. Cl.
CPC ..... *H05B 2213/05* (2013.01); *H05B 2213/07* (2013.01)

(58) Field of Classification Search
CPC ..... H05B 2213/03; H05B 2213/04; H05B 2213/05; H05B 2213/07; F24C 15/106
USPC ..... 219/620, 621, 626, 627, 628, 660, 661, 219/667, 675, 663, 664
See application file for complete search history.

(56) References Cited

FOREIGN PATENT DOCUMENTS

| | | | | | |
|---|---|---|---|---|---|
| EP | 1732357 | A2 | * | 12/2006 | ..... H05B 6/062 |
| EP | 1732357 | A2 | | 12/2006 | |
| EP | 2296435 | A1 | | 3/2011 | |
| EP | 2326140 | A1 | | 5/2011 | |
| JP | 2-280716 | A | * | 11/1990 | |
| JP | 2010165696 | A | | 7/2010 | |

* cited by examiner

METHOD FOR BOIL DETECTION AND INDUCTION HOB INCLUDING A BOIL DETECTION MECHANISM

The present invention relates generally to the field of boil detection. More specifically, the present invention is related to boil detection by monitoring electrical parameters of an induction hob.

BACKGROUND OF THE INVENTION

Induction hobs for preparing food are well known in prior art. Induction hobs typically comprise at least one induction heater which is associated with at least one induction coil. For heating a piece of cookware placed on the induction hob, the induction coil is coupled with electronic driving means for driving an AC current through the induction coil. Said AC current generates a time verifying magnetic field. Due to the inductive coupling between the inductor coil and the piece of cookware placed on the induction hob, the magnetic field generated by the inductor coil causes eddy currents circulating in the piece of cookware. The presence of said eddy currents generates heat within the piece of cookware due to the electrical resistance of said piece of cookware.

Document DE 102 53 198 B4 proposes a method for monitoring and controlling the cooking process of a piece of cookware at an induction hob. The frequency ratio between the actual frequency and the start frequency is monitored in order to determine the boil point.

A drawback of the known solution is that the accuracy of boil point detection is no satisfactory because certain detrimental influences lead to a wrong boil point detection result.

SUMMARY OF THE INVENTION

It is an objective of the embodiments of the invention to provide a reliable and robust method for detecting boil point in induction hobs using electrical parameters available within the induction hob. If not explicitly indicated otherwise, embodiments of the invention can be freely combined with each other.

According to an aspect, the invention relates to a method for boil detection at a heating zone of an induction hob. The method comprises the steps of:

- disabling a power control mechanism of the induction hob by setting the frequency of the AC-current provided to an induction coil of the induction hob to a fixed value;
- measuring values of an electrical parameter provided within the induction hob;
- interpolating the measured electrical parameter values by gathering a plurality of values of the electrical parameter within a time window and calculating the average value of said gathered plurality of values thereby obtaining interpolated electrical parameter values.
- calculating a gradient measure indicative for the differential change of the interpolated electrical parameter values over time;
- determining the boil point based on the calculated gradient measure.

Said method is advantageous because by interpolating the measured electrical parameter values and providing a gradient measure of said interpolated electrical parameter values, a robust and reliable boil detection is possible.

According to preferred embodiments, the boil point is determined by detecting whether the calculated gradient measure is zero and/or changes its sign. More in detail, the first derivative of the interpolated electrical parameter values is determined in order to obtain the gradient measure. At the boil point, the electrical parameter value may reach a minimum which can be detected in order to accurately determine the boil point. An even more exact way for determining boil point is detecting a zero crossing (+/− crossing or −/+ crossing) of the gradient measure, respectively, the first derivative of the interpolated electrical parameter values.

According to preferred embodiments, the electrical parameter is the coil peak current (current values at the peaks of the AC current), the electrical output power of an induction coil associated with the heating zone or the phase delay between the electrical current and the voltage provided to the induction coil. Said electrical parameters are correlated with the temperature of the cookware and can be used for boil detection. In preferred embodiments, the coil peak current is used for determining boil point.

According to preferred embodiments, the power control mechanism is disabled after expiry of a certain period of time after starting the cooking process. At the beginning of the cooking process, the output power may change significantly because of a significant change of temperature of the piece of cookware. By delaying the disabling of power control mechanism, the electrical output power can be kept constant at the beginning of the cooking process thereby avoiding that the electrical output power drops excessively after starting the cooking process.

According to preferred embodiments, determining the boil point is stopped and the power control mechanism is activated if the electrical output power of the induction coil drops below a certain power threshold and the boil point determination process is reinitialized after re-adjusting the electrical output power. Such activation of power control mechanism may be necessary when using a piece of cookware which shows a strong dependency of inductive properties of the cookware on changing temperature. Such strong dependency may lead to a significant drop of output power which results in an undesired extension of cooking time. By activating the power control mechanism for a limited period of time, the frequency of the AC current can be varied in order to reach the desired output power and the boil point detection is reinitialized after deactivating the power control mechanism again.

According to preferred embodiments, said interpolating of the measured electrical parameter values is performed by sampling the electrical parameter with a frequency between 1 kHz and 50 kHz and averaging the sampled values within a time window of 1 sec to 10 sec. Preferably, the sampling frequency is in the range of 5 kHz to 20 kHz, most preferably 10 kHz. The time window may be preferably between 2 sec and 5 sec, most preferably 4 sec.

According to preferred embodiments, the criteria for determining the boil point are modified based on the elapsed boil-up time and/or based on the relative change of the measured electrical parameter values. Just after starting the cooking process, the probability of reaching boil point is lower than after expiration of a certain period of time. Therefore, the criteria for determining the boil point may be adapted in order to avoid erroneous boil point detection, e.g. due to mains voltage fluctuations etc.

According to preferred embodiments, the criteria for determining the boil point are the detection de-bounce time and/or a detection threshold. Said criteria may be adapted depending to elapsed boil-up time and/or based on the relative change of the measured electrical parameter values in order to avoid false boil detection results.

According to preferred embodiments, a boil detection capability indicator showing the capability of a cookware for being used in boil detection is calculated based on the change of the interpolated electrical parameter values over time. Different pieces of cookware may show different degrees of dependency of inductive m properties on temperature changes. Even more, some pieces of cookware do show no or essentially no dependencies on temperature variations. As such, presented boil detection is not suitable for such pieces of cookware. By monitoring the change of the interpolated electrical parameter values over time, specifically at the beginning of the cooking process, an index can be derived which is indicative for the capability of cookware to be used within said boil detection method.

According to preferred embodiments, boil detection is deactivated if said boil detection capability indicator is below a certain threshold value. Thereby the usage of an inappropriate piece of cookware in the proposed boil detection mechanism is avoided which certainly may lead to wrong and undesired detection results.

According to preferred embodiments, the induction coil is powered at boost power level during boil detection, said boost power level having a power level above the highest nominal power level, wherein the induction coil is adapted to be driven at said boost power level only for a limited boost time period. Thereby, the period of time reaching boil point is reduced.

According to preferred embodiments, the boil detection capability indicator is established before said boost time period is elapsed and the boil detection mechanism is stopped and the induction coil is driven in standard boost mode if said indicator shows that the cookware is not capable for being used in said boil detection mechanism. Thereby, an undesired extension of powering the induction coil at maximum power because of not being able to determine the boil point is avoided.

According to preferred embodiments, the mains voltage is monitored in order to detect mains voltage fluctuations and the measured electrical parameters are modified based on a compensation formula using said monitored mains voltage. Thereby, detrimental influence of mains voltage fluctuations can be avoided.

According to preferred embodiments, the change rate of the measured electrical parameter values or interpolated electrical parameter values is monitored and the boil detection is reinitialized if the change rate exceeds a certain threshold value. Movements of a piece of cookware may also lead to changes of the measured electrical parameter. However, the change rate caused by movements of a piece of cookware is typically much higher than the change rate caused by temperature changes. As such, by monitoring the change rate and comparing the change rate with a threshold value, parameter value changes caused by cookware movements can be detected and filtered out in order to avoid wrong boil detection results.

According to a second aspect, the invention relates to an induction hob comprising one or more induction coils associated with a heating zone. The induction hob comprises a control entity being adapted to:

- disable a power control mechanism by setting the frequency of the AC-current provided to the induction coil to a fixed value;
- measure values of an electrical parameter provided within the induction hob;
- interpolate the measured electrical parameter values by gathering a plurality of values of the electrical parameter within a time window and calculate the average value of said gathered plurality of values thereby obtaining interpolated electrical parameter values.
- calculate a gradient measure indicative for the differential change of the interpolated electrical parameter values over time; and
- determine the boil point based on the calculated gradient measure.

The term "essentially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
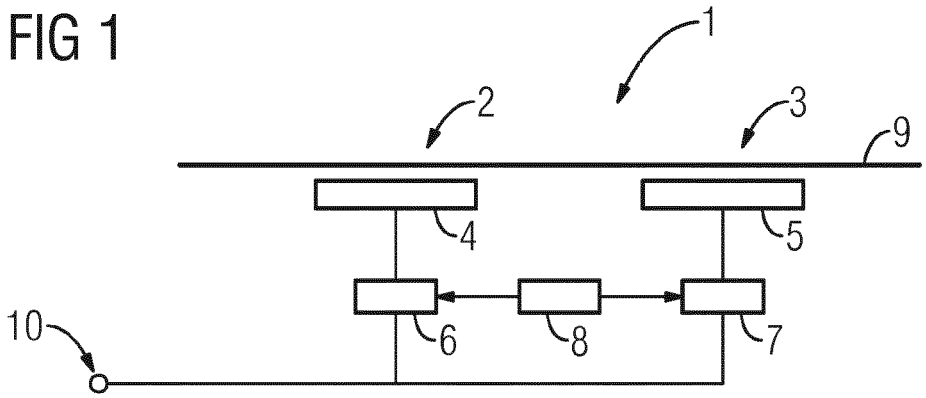
FIG. 1 shows a schematic view of an induction hob according to the current invention.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows a schematic illustration of an induction hob 1. The induction hob 1 comprises at least one induction heater 2, 3, preferably provided at a hob plate 9. Beneath the hop plate 9, one or more induction coils 4, 5 are provided wherein each induction heater 2, 3 is associated with one or more induction coils 4, 5. Each induction coil 4 is coupled with electronic driving means 6, 7. Said electronic driving means 6, 7 are coupled with a mains supply 10. Furthermore, a control unit 8 is provided for controlling the operation of the electronic driving means 6, 7, specifically for adjusting the output power of the induction coils 4, 5.

The induction hob comprises a power control mechanism in order to provide constant heating power to a piece of cookware placed above the induction heater 2, 3. Typically, the magnetic resistance of the pot is increasing with increasing temperature leading to a lower output power, respectively, coil current in absence of a power control mechanism. In order to provide constant power to the piece of cookware independent of the temperature, the power control mechanism may adjust the frequency of the AC current provided to the induction coil 4, 5 in order to provide a certain power to the piece of cookware. More in detail, the power control mechanism may decrease the frequency in order to stabilize the power provided to the piece of cookware. When operating the induction hob 1 at a fixed power level set by a user at a user interface, the power control mechanism may be executed in background in order to avoid a decreasing of power with rising temperature of the piece of cookware.

As already mentioned before, electrical signals being able to be monitored within the induction hob are strongly correlated with the temperature of the piece of cookware placed above the induction coil. So, by monitoring and analysing one or more electrical signals within the induction hob, information regarding the temperature of the piece of cookware can be derived.

Figure 2:
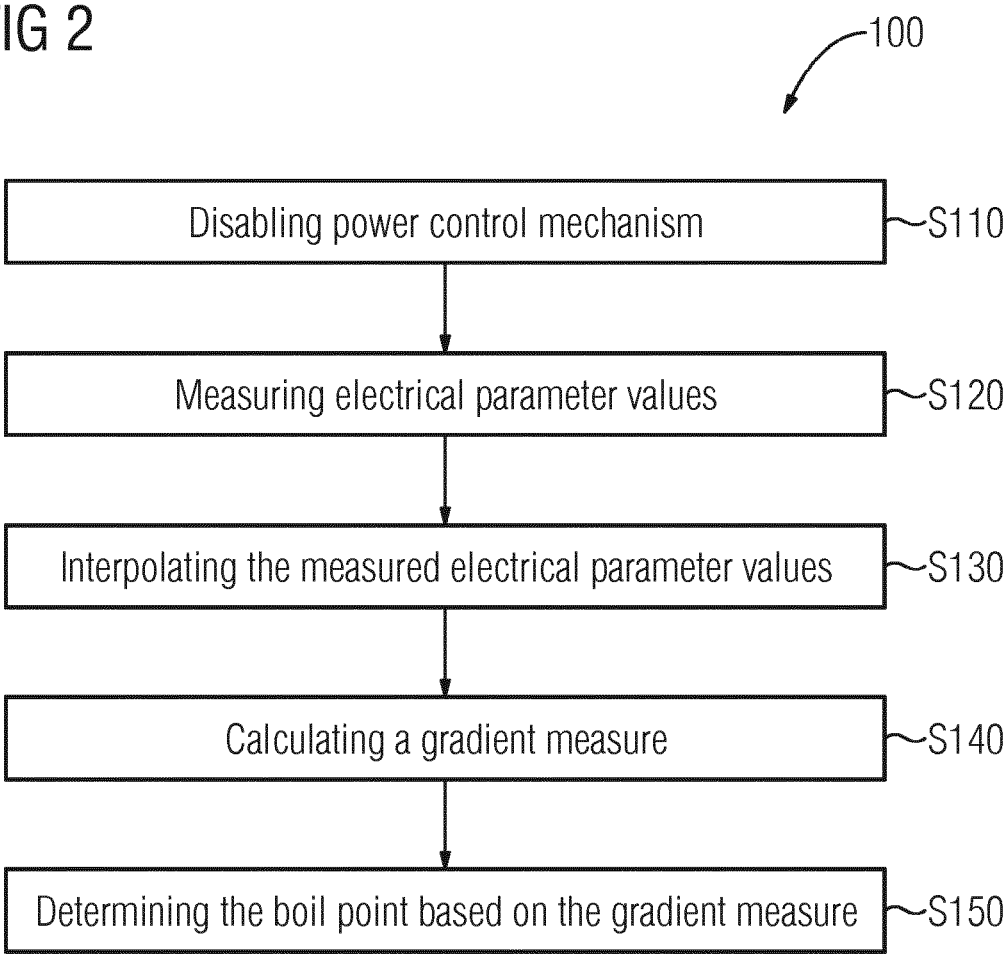
FIG. 2 shows a flow chart of a method for boil detection.

FIG. 2 shows a flowchart of a method 100 for boil detection at the heating zone of an induction hob 1. As mentioned before, the power control mechanism is configured to change electrical parameters, specifically the frequency of the AC current provided to the induction coil in order to obtain a constant output power. So, the power control mechanism automatically varies electrical parameters. As a result, variations of the electrical parameters can be caused by temperature variations of the piece of cookware and/or by said automatic boil control mechanism. In order to avoid a superposition of factors having influence on the variation of electrical parameters, the power control mechanism is deactivated (S110). By deactivating the power control mechanism, the frequency is set at the fixed value during capturing values of at least one electrical parameter correlated with the temperature of the piece of cookware.

After deactivating the power control mechanism, values of at least one electrical parameter are measured (S120). It is worth mentioning that electrical parameters are used which are already available within the induction hob 1, specifically available within the control unit 8 of the induction hob 1. Thus, no external sensors for performing said measurements are necessary.

Different electrical parameters can be used for determining the boil point of the piece of cookware. For example, the output power of the induction coil, the phase delay between the electric current provided to the induction coil and the electric voltage applied at the induction coil or the coil peak current can be used as such parameter. Preferably, the coil peak current is used. The term "coil peak current" means that current values at the maxima of the current curve (which is an oscillating AC signal) are determined and used for boil point detection.

In order to accurately determine the boil point, a high measurement resolution is necessary. Limiting conditions are, for example, the resolution of the AD converter used for converting the electrical parameters from the analog domain to the digital domain and noise which superimposes the variation of electrical parameter induced by changes of temperature of the piece of cookware. The term "noise" as used in the present disclosure means any fluctuations of the measured electrical parameter, for example, caused by background noise within the induction hob 1 (gaussian noise), mains voltage variations and/or cookware movements etc.

For improving the boil point detection accuracy, an interpolation of measured electrical parameters is performed (S130). More in detail, the electrical parameters provided by the AD converter are averaged and interpolated for a long period of time, in which the frequency of the AC current is kept at a fixed value. By performing said averaging/interpolation, interpolated electrical parameter values are derived from the measured parameter values. Said interpolation and averaging is advantageous because common embedded microcontrollers have typically a conversion accuracy of 10 or 12 bit conversion accuracy. However, the noise overlaying the measured electrical parameter is typically higher than the resolution of the microcontroller. By means of said averaging, the influence of noise can be reduced and the detection accuracy can be significantly increased.

In an example implementation, a subset of measured electrical parameter values is used for averaging and interpolating. Said subset may be captured in a certain period of time. For example, 50% to 90%, specifically 60%, 70% or 80% of the measured electrical parameter values are captured in a time period of 1 sec to 10 sec, for example, 2 sec, 3 sec, 4 sec, 5 sec, 6 sec, 7 sec, 8 sec or 9 sec, specifically in a time period of 4 sec for said interpolation. According to preferred embodiments, the measured electrical parameter values may be peak values of the high frequency current. Said peak values may be, for example, provided by a hardware circuit or by means of software processing. Said peak values may be sampled at a certain frequency, e.g. at a frequency in the range of 5 kHz to 20 kHz, specifically 10 kHz.

In order to further increase the detection accuracy, a gradient of the interpolated electrical parameter values is calculated (S140). More in detail, the first derivative of the time curve of the interpolated electrical parameter is calculated and the boil detection is performed based on said first derivative. The first derivative is indicative for the increase/decrease of the electrical parameter and therefore also indicative for the increase/decrease of the temperature of the piece of cookware. If the boil point is reached, the gradient of the time curve of the interpolated electrical parameter approaches zero. So, based on the gradient of the interpolated electrical parameter values, the boil point is determined (S150). In addition, in most cases, the gradient of the time curve may get negative after crossing zero value, i.e. before reaching the boil point the gradient of the time curve is positive and turns slightly negative just when the boil point has been reached. Therefore, the boil point detection mechanism may be adapted to detect said zero-crossing of the gradient of the interpolated electrical parameter from the positive range into the negative range in order to accurately detect the boil point.

Specifically just after the starting the cooking process, the power control mechanism may perform a significant adaption of the frequency of the AC current provided to the induction coil because the temperature variation at the beginning of the cooking process is very high. Therefore it is advantageous to deactivate the power control mechanism not directly after starting the cooking process but delaying said deactivation for a certain period of time in order to allow the power control mechanism to adjust the power provided to the piece of cookware in an early state of the cooking process. The delay may be, for example, in the area of 20-30 sec.

Upper-mentioned disabling of the power control mechanism may lead to situations, in which the output power of the induction coil is significantly decreased leading to an undesired delay in reaching the boil point. In order to avoid an unacceptable lowering of output power, the power control mechanism may be restarted if the output power drops below a certain threshold. Said threshold may be an absolute threshold value or may be a relative threshold, referring to the output power value at the point of time at which the power control mechanism has been deactivated. For example, the threshold value may be defined as a certain percentage value (e.g. 10-15%), said percentage value indicating the range in which a decrease of output power is tolerated. In case that the output power drops below said threshold value, the boil point detection mechanism may be deactivated as long as the power control mechanism is activated. After terminating the power control mechanism, the boil point detection mechanism is reinitialized again. Thereby, undesired lowering of the output power can be avoided.

In order to further improve the boil point detection, a dynamic adaption of criteria for detecting boil point can be performed. For example, depending on the state of the cooking process, the criteria for detecting boil point may be adapted. More specifically, the criteria may be adapted if the probability of reaching the boil point passes a certain threshold. For example, the elapsed cooking time and/or the relative change of the measured electrical parameter values may be used for adapting said criteria. The adapted criteria may be a detection threshold used for detecting said boil point or detection de-bounce time. Said detection de-bounce time indicates that before signaling a real boil detected state, the criteria to detect boiling must be fulfilled for a certain period of time. Said criteria have to be fulfilled either permanently for a given period or for a certain percentage of time during a given period.

The correlation of the electrical parameters to be measured within the induction hob and the temperature of the piece of cookware strongly depends on properties of the cookware, specifically depends on the material of the cookware. Some available cookware shows properties which lead to no or essentially no variation of electrical parameters within the induction hob when the temperature of the cookware is changing. As such, the proposed boil detection mechanism should not be performed when using such cookware. In order to detect the capability of a piece of cookware to be used for the proposed boil detection, an algorithm is included in the induction hob, said algorithm providing a measure for using the boil detection method for the present piece of cookware. Said algorithm may evaluate the relative change of the measured electrical parameter values within a certain period of time after starting the cooking process. Said period of time may directly start after beginning the cooking process or may be delayed for a certain period of time. If the relative change of the measured electrical parameter values is below a certain threshold, it is noticed that the pot is not suitable for boil detection. As such the boil detection mechanism is cancelled. In addition, an indication (visual and/or audible) may be provided in order to inform the user of the induction hob that the boil detection has been aborted. In addition, even if the cookware is classified as being usable in said pot detection mechanism, the quality of the cookware for being used in the pot detection mechanism can be provided at a user interface.

The induction hob may provide a boost power level which is higher than the highest nominal power level. After activating the boost power level, the hob will revert to a lower power level after a predetermined period of time (so-called standard boost time). The boil detection mechanism may use said boost power level for powering the induction coil as long as boil point has been detected.

Upper-mentioned index indicating the usability of the cookware in said boil detection mechanism may be established before standard boost time has been elapsed. In case that the index shows the inability of the cookware to be used in boil detection mechanism, the induction hob may revert to standard boost mode which may be terminated after elapsing of standard boost time. Otherwise, the induction coil may be powered at boost power level until the boil point is reached.

As mentioned before, one interfering factor for accurate determination of boiling point is variations in mains voltage. The measured electrical parameter which is correlated with the temperature of the piece of cookware is also influenced by mains voltage variations/fluctuations. So, fluctuations in mains voltage may lead to variations of electrical parameters that could be interpreted as temperature variations and thus may lead to wrong boil point detection.

However, mains voltage can be measured independently within the induction hob. Measurement values of the mains voltage can be used within a compensation scheme for compensating the influence of mains voltage fluctuations on point detection process. More in detail a compensation formula may be provided (e.g. based on practical measurements) which takes mains voltage fluctuations into account and provides a mains voltage compensated output signal to be used for boil detection.

In addition, a further detrimental factor influencing boil point detection is moving the piece of cookware at the hob plate. Said movements may also lead to variations of electrical parameter that could be interpreted as temperature variations and thus may lead to wrong boil point detection. However, in most cases, the change of electrical parameter (amount of change per time unit) caused by moving the piece of cookware is much faster than the change of electrical parameter caused by temperature variations. Therefore, in order to be able to recognize cookware movements, the variation speed of the measured electrical parameter is detected in order to decide whether the change of electrical parameter is caused by temperature variation or by cookware movement. In case that a pot movement is detected and the change of the electrical parameter caused by said pot movement is detrimental for boil detection, the boil detection mechanism may be stopped and reinitialized. For example, boil detection may be continued with a new offset of the measured electrical parameter.

Figure 3:
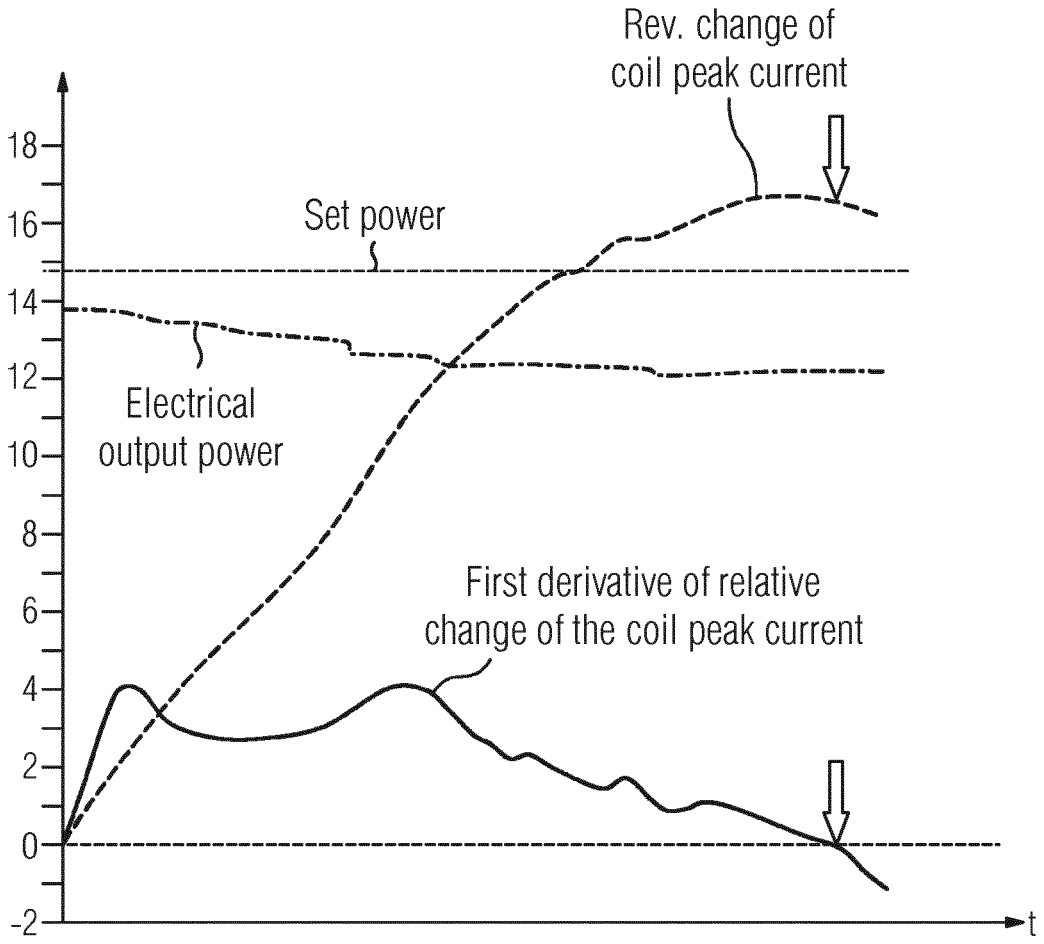
FIG. 3 shows multiple graphs indicating changes of measured or calculated values for detecting boil point.

FIG. 3 shows multiple graphs electrical parameters or parameters derived from electrical parameters over time. Specifically, the selected electrical output power provided to the induction coil, the measured electrical output power provided to the induction coil, the relative change of the coil peak current (current value of the coil peak current minus start value of the coil peak current) (the relative change is negative) and the first derivative of the relative change of the coil peak current are shown. With rising temperature of the cookware, the electrical output power is decreasing (because of the deactivated power control mechanism). As a result, the coil peak current is also decreasing over time. Having a look at the curves of the relative change of the coil peak current and the first derivative of the relative change of the coil peak current, the relative change reaches a maximum (as indicated by the arrow). The first derivative of the relative change of the coil peak current turns from positive range into negative range (also indicated by the arrow). That zero crossing, respectively, maximum is indicative for the boiling point and may be detected by the boil point detection mechanism in order to accurately determine the boil m point.

It should be noted that the description and drawings merely illustrate the principles of the proposed induction hob, respectively boil point detection method. Those skilled in the art will be able to implement various arrangements that, although not explicitly described or shown herein, embody the principles of the invention.

LIST OF REFERENCE NUMERALS

1 induction hob
2 first induction heater
3 second induction heater
4 first induction coil
5 second induction coil
6 electronic driving means
7 electronic driving means
8 control unit
9 hob plate
10 mains supply
100 boil detection method

The invention claimed is:

1. A method for boil detection at a heating zone of an induction hob, the method comprising the steps of:

disabling a power control mechanism of the induction hob by setting a frequency of AC-current provided to an induction coil of the induction hob associated with the heating zone to a fixed value;

measuring values of an electrical parameter provided within the induction hob;

interpolating the measured electrical parameter values by gathering a plurality of said values of the electrical parameter within a time window and calculating an average value of said gathered plurality of values thereby obtaining interpolated electrical parameter values;

calculating a gradient measure indicative for a differential change of the interpolated electrical parameter values over time;

determining a boil point based on the calculated gradient measure.

2. The method according to claim 1, wherein the boil point is determined by detecting whether the calculated gradient measure is zero and/or changes in its sign.

3. The method according to claim 1, wherein the electrical parameter is a peak current of the induction coil, an electrical output power of the induction coil, or a phase delay between the AC current and a voltage provided to the induction coil.

4. The method according to claim 1, wherein the power control mechanism is disabled after expiry of a certain period of time after starting a cooking process.

5. The method according to claim 1, wherein determining the boil point is stopped and the power control mechanism is activated if an electrical output power of the induction coil drops below a certain power threshold and the boil point determination process is reinitialized after re-adjusting the electrical output power.

6. The method according to claim 1, wherein interpolating the measured electrical parameter values is performed by sampling the electrical parameter with a frequency between 1 kHz and 50 kHz and averaging the sampled values within a time window of 1 sec to 10 sec.

7. The method according to claim 1, wherein criteria for determining the boil point are modified based on elapsed boil-up time and/or based on a relative change of the measured electrical parameter values.

8. The method according to claim 7, wherein the criteria for determining the boil point are a detection de-bounce time and/or a detection threshold.

9. The method according to claim 1, wherein a boil detection capability indicator showing a capability of a cookware for being used in boil detection is calculated based on the change of the interpolated electrical parameter values over time.

10. The method according to claim 9, wherein boil detection is deactivated if said boil detection capability indicator is below a certain threshold value.

11. The method according to claim 1, wherein the induction coil is powered at boost power level during boil detection, said boost power level having a power level above a highest nominal power level, wherein the induction coil is adapted to be driven at said boost power level only for a limited boost time period.

12. The method according to claim 11, wherein the boil detection capability indicator is established before said boost time period is elapsed and the boil detection mechanism is stopped and the induction coil is driven in standard boost mode if said indicator shows that a cookware is not capable for being used in said boil detection mechanism.

13. The method according to claim 1, wherein mains voltage is monitored in order to detect mains voltage fluctuations and the measured electrical parameters are modified based on a compensation formula using said monitored mains voltage.

14. The method according to claim 1, wherein a change rate of the measured electrical parameter values or interpolated electrical parameter values is monitored and the boil detection is reinitialized if the change rate exceeds a certain threshold value.

15. An induction hob comprising one or more induction coils associated with a heating zone, the induction hob comprising a control entity being adapted to:

disable a power control mechanism by setting a frequency of AC-current provided to the induction coil to a fixed value;

measure values of an electrical parameter provided within the induction hob;

interpolate the measured electrical parameter values by gathering a plurality of values of the electrical parameter within a time window and calculate an average value of said gathered plurality of values thereby obtaining interpolated electrical parameter values;

calculate a gradient measure indicative for a differential change of the interpolated electrical parameter values over time; and determine a boil point based on the calculated gradient measure.

16. A method for boil detection at a heating zone of an induction hob, the method comprising:

initiating a cooking process by activating a supply of AC current to an induction coil associated with said cooking hob;

during a first time period of said cooking process, maintaining a constant output power level of said induction coil by increasing a frequency of said AC current in order to compensate for increasing resistance in a cookware in said cooking zone as its temperature increases during said first time period;

thereafter, during a second time period of said cooking process, maintaining the frequency of said AC current at a fixed frequency and measuring peak current values of said AC current sampled at a frequency of 5 kHz to 20 kHz and averaging the sampled peak current values within a window of 1 to 10 seconds, interpolating interpolated values of said peak current from the averaged sample values thereof, and determining a first derivative of a time curve of said interpolated peak current values;

detecting when said cookware has reached a boiling point temperature during said second time period based on boiling-point criteria by monitoring when said first derivative of said time curve reaches zero and/or changes sign; and upon the output power of said induction coil dropping to or below a threshold power level during said second time period, concluding said second time period and resuming maintenance of said constant output power of said induction coil by increasing the frequency of said AC current to again compensate for increasing resistance in the cookware, wherein said boiling-point temperature detection is suspended while the the output power level of said induction coil is maintained at said constant output power level.

17. The method according to claim 16, said boiling-point criteria being variable between a first criterion applicable during an an initial part of said second time period when a probability of said cookware reaching the boiling point temperature is a first probability, and a second criterion applicable during a subsequent part of said second time period when the probability of said cookware reaching the boiling point temerature is a second probability higher than said first probability, wherein said first criterion is more stringent than said second criterion such that achievement of the boiling point temperature by said cookware is less likely to be detected during the first part of said second time period than during said second part of said second time period under comparable cookware conditions.

18. The method according to claim 17, further comprising concluding said first part of said second time period upon elapsing of a predetermined period of time, said boiling point criteria comprising a pedetermined length of time during which said first derivative of said time curve remains zero and/or negative, wherein the first criterion represents a longer predetermined length of time than said second criterion.

19. The method according to claim 17, further comprising concluding said first part of said second time period upon said first derivative of said time curve falling to or below a predetermined first-derivative threshold indicating that a rate of change of temperature for said cookware has fallen below a corresponding predetermined temperature-rate threshold, wherein the first criterion represents a longer predetermined length of time than said second criterion.

20. The method according to claim 16, further comprising, after initiation of said cooking process but prior to said second time period, during an evaluation time period evaluating a temperature dependence of the electrical resistivity of said cookware by measuring said peak current values of said AC current as said cookware is heated, and:

determining said cookware to be unsuitable for said detection of said boiling point temperature if said peak current values increase at a rate below a suitability threshold during said evaluation time period; and determining said cookware to be suitable for said detection of said boiling point temperature if said peak current value increases at a rate of or higher than said suitability threshold during said evaluation time period;

wherein said detection step is canceled if said cookware is determined to be unsuitable for said detection of said boiling point temperature.

* * * * *